US005402646A

United States Patent [19]

Rathbone

[11] Patent Number: 5,402,646

[45] Date of Patent: Apr. 4, 1995

[54] AIR SEPARATION

[75] Inventor: Thomas Rathbone, Farnham, England

[73] Assignee: The BOC Group plc, Windlesham, England

[21] Appl. No.: 204,848

[22] Filed: Mar. 2, 1994

[30] Foreign Application Priority Data

Mar. 8, 1993 [GB] United Kingdom ..... 9304710

[51] Int. Cl.[6] ..... F25J 3/02

[52] U.S. Cl. ..... 62/24; 62/38; 62/41

[58] Field of Search ..... 62/24, 38, 41

[56] References Cited

U.S. PATENT DOCUMENTS 4,208,199 6/1980 Nakazato et al. ..... 62/29
4,410,343 10/1983 Ziemer ..... 62/29
5,251,449 10/1993 Rottmann ..... 62/41

FOREIGN PATENT DOCUMENTS 3307181 9/1984 Germany .

*Primary Examiner*—Ronald C. Capossela
*Attorney, Agent, or Firm*—David M. Rosenblum; Larry R. Cassett

[57] ABSTRACT

A first stream of compressed, cooled air is introduced into a higher pressure rectification column through an inlet and is separated into nitrogen vapour and oxygen-enriched liquid. At least some of the nitrogen vapor is condensed in a condenser and one stream of the resulting liquid nitrogen is used as reflux in the column and another stream as reflux in a lower pressure rectification column. Oxygen enriched liquid withdrawn from the column through an outlet is separated in the column. Impure liquid oxygen product is withdrawn from the column through an outlet. A less pure stream of liquid oxygen is withdrawn from the column through an outlet, is reboiled in a condenser-reboiler by indirect heat exchange with a second stream of air and is reintroduced into the column at its bottom through an inlet.

16 Claims, 3 Drawing Sheets

AIR SEPARATION

BACKGROUND OF THE INVENTION

This invention relates to a method and apparatus for separating air.

The most important method commercially of separating air is by rectification. The most frequently used air separation cycles include the steps of compressing a stream of air, purifying the resulting stream of compressed air by removing water vapour and carbon dioxide, and cooling the stream of compressed air by heat exchange with returning product streams to a temperature suitable for its rectification. The rectification is performed in a so-called "double rectification column" comprising a higher pressure and a lower pressure rectification column i.e. one of the two columns operates at higher pressure than the other. Most if not all of the air is introduced into the higher pressure column and is separated into oxygen-enriched liquid air and liquid nitrogen vapour. The nitrogen vapour is condensed. A part of the condensate is used as liquid reflux in the higher pressure column. Oxygen-enriched liquid is withdrawn from the bottom of the higher pressure column, is sub-cooled, and is introduced into an intermediate region of the lower pressure column through a throttling or pressure reduction valve. The oxygen-enriched liquid is separated into substantially pure oxygen and nitrogen products in the lower pressure column. These products are withdrawn in the vapour state from the lower pressure column and form the returning streams against which the incoming air stream is heat exchanged. Liquid reflux for the lower pressure column is provided by taking the remainder of the condensate from the higher pressure column, sub-cooling it, and passing it into the top of the lower pressure column through a throttling or pressure reduction valve.

Conventionally, the lower pressure column is operated at pressures in the range of 1 to 1.5 atmospheres absolute. Liquid oxygen at the bottom of the lower pressure column is used to meet the condensation duty at the top of the higher pressure column. Accordingly, nitrogen vapour from the top of higher pressure column is heat exchanged with liquid oxygen in the bottom of the lower pressure column. Sufficient liquid oxygen is able to be evaporated thereby to meet the requirements of the lower pressure column for reboil and to enable a good yield of gaseous oxygen product to be achieved. The pressure at the top of the higher pressure column and hence the pressure to which the incoming air is compressed are arranged to be such that the temperature of the condensing nitrogen is a degree or two Kelvin higher than that of the boiling oxygen in the lower pressure column. In consequence of these relationships, it is not generally possible to operate the higher pressure column below a pressure of about 5.5 bar.

Improvements to the air separation process enabling the higher pressure column to be operated at a pressure below 5.5 bar have been proposed when the oxygen product is not of high purity, containing, say, from 3 to 20% by volume of impurities. U.S. Pat. No. 4,410,343 (Ziemer) discloses that when such lower purity oxygen is required, rather than having the above-described link between the lower and higher pressure columns, air is employed to boil oxygen in the bottom of the lower pressure column in order both to provide reboil for that column and to evaporate the oxygen product. The resulting condensed air is then fed into both the higher pressure and the lower pressure columns. A stream of oxygen-enriched liquid is withdrawn from the higher pressure column, is passed through a throttling valve and a part of it is used to perform the nitrogen condensing duty at the top of the higher pressure column.

U.S. Pat. No. 3,210,951 also discloses a process for producing impure oxygen in which air is employed to boil oxygen in the bottom of the lower pressure column in order both to provide reboil for that column and to evaporate the oxygen product. In this instance, however, oxygen-enriched liquid from an intermediate region of the lower pressure column is used to fulfil the duty of condensing nitrogen vapour produced in the higher pressure column. This process is at least in theory capable of reducing the operating pressure of the higher pressure column to below 5 bar.

SUMMARY OF THE INVENTION

The present invention relates to a method and apparatus for separating an impure oxygen product from air which for a given pressure at the bottom of the lower pressure rectification column makes possible the operation of the higher pressure rectification at a particularly low pressure at the bottom thereof. For example if the pressure at the bottom of the lower pressure column is in the order of 1.4 bar, the method according to the invention may be operated with a pressure at the bottom of the higher pressure column in the order of 3 bar.

According to the present invention there is provided a method of separating air comprising rectifying a first stream of air in a higher pressure rectification column and thereby producing nitrogen vapour and oxygen-enriched liquid; condensing at least some of the nitrogen vapour and employing a first stream of resulting condensate as reflux in the higher pressure rectification column and a second stream of the condensate as reflux in a lower pressure rectification column; withdrawing from the higher pressure rectification column a stream of said oxygen-enriched liquid, rectifying it in the lower pressure column and producing thereby an impure liquid oxygen product; withdrawing said impure liquid oxygen product from the lower pressure rectification column in the liquid state, and providing a flow of reboiled liquid upwardly through the lower pressure rectification column by withdrawing from the lower pressure rectification column an intermediate stream of liquid whose oxygen concentration is greater than that of the said oxygen-enriched liquid but less than that of the said liquid oxygen product, reboiling the intermediate stream by heat exchange with a second stream of air, and returning the resulting reboiled intermediate stream to a bottom region of the lower pressure rectification column.

The invention also provides apparatus for separating air comprising a higher pressure rectification column for separating a first stream of air into nitrogen vapour and oxygen-enriched liquid, a lower pressure rectification column for producing an impure liquid oxygen product having an inlet for oxygen-enriched liquid withdrawn from said higher pressure rectification column, a condenser for condensing nitrogen separated in the higher pressure rectification column, means for supplying resulting condensate as reflux to the higher pressure rectification and to a lower pressure rectification column, an outlet from the lower pressure rectification column for said impure liquid oxygen product, a reboiler for boiling by heat exchange with a second stream of air an intermediate stream of liquid withdrawn from the lower pressure rectification column at a region intermediate said inlet and said outlet, and means for returning the resulting reboiled liquid to the bottom of the lower pressure rectification column.

Since the intermediate stream inevitably has a lower temperature than the impure liquid oxygen product, there is made possible heat exchange between the second air stream and the intermediate stream in a temperature range lower than that which would arise in the event of the heat exchange being between the second air stream and the impure liquid oxygen product. With the second air stream being at least partially and preferably fully condensed by its heat exchange with the intermediate stream, the consequence is that a lower second air stream pressure may be used than that which would otherwise be needed for boiling the impure liquid oxygen product in order to provide reboil for the lower pressure rectification column. Since the second air stream condenses and the intermediate stream reboils within discrete temperature ranges it is possible to match the temperature-enthalpy profile of the condensing second air stream with that of the reboiling intermediate stream, thus making possible efficient heat exchange between the two streams. The oxygen content of the intermediate stream is preferably in the range of 50% to 85% by volume, most preferably in the order of 75%.

The nitrogen vapour produced in the higher pressure rectification column is preferably condensed by heat exchange with oxygen-enriched liquid. The oxygen-enriched liquid stream is preferably used for this purpose, being at least partially reboiled thereby. Thus, at least part of the oxygen-enriched liquid stream is vaporised upstream of its introduction into the lower pressure rectification column.

The first and second air streams are each preferably formed by removing carbon dioxide and water vapour from a flow of compressed air and cooling the resulting purified air flow in a main heat exchanger by countercurrent heat exchange with the impure liquid oxygen product and with a nitrogen stream withdrawn from the lower pressure rectification column.

If the lower pressure rectification column is operated at a pressure at its bottom in the order of 1.5 bar or less, the impure liquid oxygen product is preferably withdrawn from the lower pressure rectification column by a pump which raises the pressure of the product to a required supply pressure, the impure liquid oxygen being vaporised by its passage through the main heat exchanger. In order to achieve efficient heat exchange, the vaporising impure liquid oxygen product is preferably heat exchanged in the main heat exchanger with a third air stream at a pressure higher than either the pressure of the first air stream or the pressure of the second air stream. The third air stream is preferably at least thereby partially condensed (unless it is at a supercritical pressure). At least part of the partially or fully condensed third air stream is preferably introduced into the higher pressure rectification column. The second air stream is also preferably introduced into the higher pressure rectification column downstream of its heat exchange with the intermediate stream.

If the bottom of the lower pressure rectification column is operated at a substantially higher pressure than 1.5 bar, the impure liquid oxygen product is preferably reduced in pressure and vaporised in countercurrent heat exchange with the condensing nitrogen vapour from the higher pressure rectification column.

Refrigeration requirements for the method according to the invention may be met by employing at least one expansion turbine to expand with the performance of external work an elevated pressure stream of air or nitrogen. Preferably, a part of the third air stream is taken therefrom and is expanded with the performance of external work in a turbine to the pressure of the higher pressure rectification column and at least part of the expanded air is introduced into the higher pressure rectification column. If desired, the expanded part of the third air stream may be combined with the second air stream upstream of the heat exchange of the second air stream with the intermediate stream. It is alternatively possible to expand in a turbine said part of the third air stream to the pressure of the lower pressure rectification column and to introduce the resulting expanded air into the lower pressure rectification column. Another alternative is to take a stream of nitrogen from the higher pressure rectification column, to warm the stream and then expand it in a turbine to create necessary refrigeration for the method according to the invention. Typically, however, depending on the operating pressure of the higher pressure rectification column, it may be necessary to form a nitrogen stream for expansion in a turbine by taking a stream of nitrogen from the higher pressure column, warming it to ambient temperature, compressing it, and then cooling it.

The method and apparatus according to the invention are most suited for producing an impure oxygen product containing not more than 93% by volume of oxygen. The higher pressure rectification column may then be operated at a pressure as low as about 3 bar.

BRIEF DESCRIPTION OF THE DRAWINGS

The method and apparatus according to the present invention will now be described by way of example with reference to the accompanying drawings, in which each of FIGS. 1 to 3 is a schematic flow diagram of an air separation plant.

DETAILED DESCRIPTION

Figure 1:
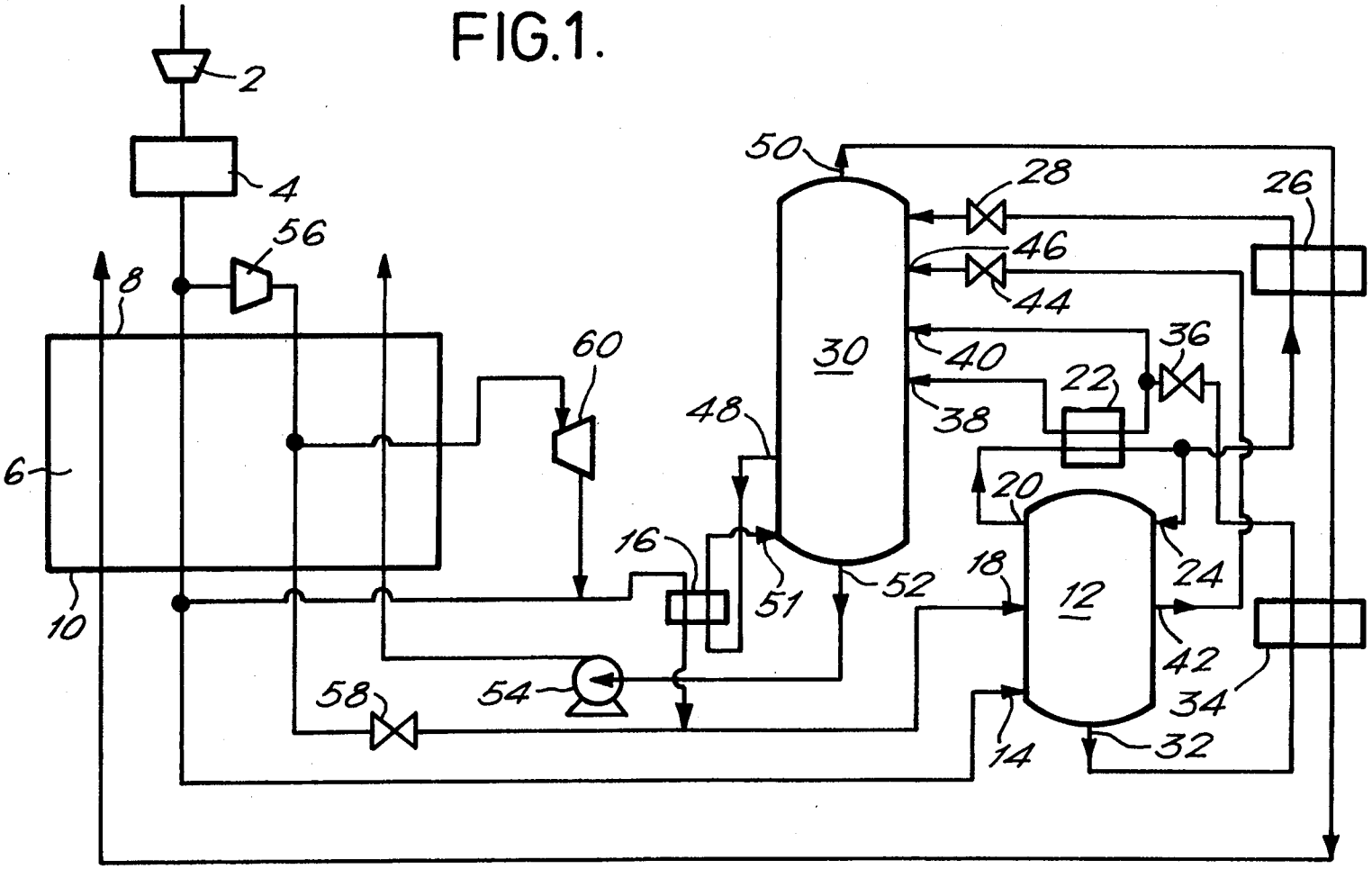

Referring to FIG. 1 of the drawings, air is compressed in a compressor 2 to a pressure of 3 bar. The resulting flow of compressed air passes through a purification apparatus or unit 4 effective to remove water vapour and carbon dioxide from the air. The unit 4 employs beds of adsorbent (not shown) to effect this removal of water vapour and carbon dioxide. The beds are operated out of sequence with one another typically such that while one or more beds are being used to purify air the remainder are being regenerated, for example by means of a stream of hot nitrogen. Such purification apparatus and its operation are well known in the art and need not be described further.

The purified air flow passes through a main heat exchanger 6 from its warm end 8 to its cold end 10. The air flow is thereby reduced in temperature from about ambient temperature to a temperature suitable for its separation by rectification. The air flow typically leaves the cold end 10 of the main heat exchanger 6 as a vapour at its saturation temperature. The air flow is then divided into first and second streams. The first air stream is introduced into a bottom region of a higher pressure rectification column 12 through an inlet 14. The higher pressure rectification column 12 contains liquid-vapour contact devices (not shown) whereby a descending liquid phase is brought into intimate contact with an ascending vapour phase such that mass transfer between the phases takes place. The liquid-vapour contact means may for example comprise distillation trays (preferably of the sieve kind) or packing (preferably structured packing). In operation of the higher pressure rectification column 12, liquid collects at the bottom thereof. Since the first air stream is introduced into a bottom region of the higher pressure column 12, the liquid at the bottom of the column 12 is approximately in equilibrium with such air, and since oxygen is less volatile than the other main components (nitrogen and argon) of the air, the liquid contains a greater mole fraction of oxygen than is in the incoming gaseous air. Typically, the higher pressure rectification column 12 is designed with sufficient theoretical plates to enable substantially pure nitrogen vapour to be produced at its top.

Thus, the higher pressure rectification column 108 produces an oxygen-enriched liquid fraction at its bottom and a nitrogen vapour fraction at its top. The second air stream flows through a first condenser-reboiler 16 and is thereby fully condensed. The condensed second air stream flows into the higher pressure rectification column 12 through an inlet 18 located above the inlet 14.

Liquid nitrogen reflux for the higher pressure rectification column 12 is formed by withdrawing nitrogen vapour therefrom through an outlet 20 at its top, condensing the nitrogen vapour in a second condenser-reboiler 22 and returning a stream of the condensed nitrogen to the top of the rectification column 12 through an inlet 24. Another stream of the condensed nitrogen is sub-cooled in a heat exchanger 26 and flows through a pressure reduction or throttling valve 28 into the top of a lower pressure rectification column 30 as reflux. The lower pressure rectification column 30 is provided with similar liquid-vapour contact devices (not shown) to those used in the higher pressure rectification column 12 in order to bring a descending liquid phase into intimate contact with an ascending vapour phase such that mass transfer between the two phases takes place.

A stream of oxygen-enriched liquid is withdrawn from the bottom of the higher pressure rectification column 12 through an outlet 32, is sub-cooled in a heat exchanger 34 and flows through a pressure reducing or throttling valve 36. The resulting oxygen-rich liquid stream is divided into two subsidiary streams. A first subsidiary stream flows through the second condenser-reboiler 22 thereby providing the necessary refrigeration for the condensation of the nitrogen vapour withdrawn from the higher pressure rectification column 12 through the outlet 20. The first subsidiary oxygen-rich liquid stream is boiled as a result of the heat exchange with the condensing nitrogen vapour and the resulting boiled oxygen-rich liquid is introduced into the lower pressure column 30 through an inlet 38. The second subsidiary oxygen-rich liquid stream is introduced into the lower pressure rectification column 30 through an inlet 40 located above the inlet 38. A liquid or vapour stream having a composition approximating to that of air is also withdrawn from the lower pressure rectification column 12 through an outlet 42 and flows through a pressure reducing or throttling valve 44. The resulting pressure reduced fluid enters the lower pressure rectification column 30 through an inlet 46 located above the inlet 40. The fluids introduced into the lower pressure rectification column 30 through the inlets 38, 40 and 46 are separated therein into nitrogen vapour and impure liquid oxygen. The pressure at the top of the rectification column 30 is typically in the order of 1.3 bar.

In order to provide an upward flow of vapour from bottom to top of the lower pressure rectification column 30, a stream (the "intermediate" stream) of liquid is withdrawn from the lower pressure rectification column 30 through an outlet 48 at a level such that a liquid typically containing 75% by volume oxygen is withdrawn. The intermediate stream flows through the first condenser-reboiler 16 countercurrently to the second air stream in heat exchange relationship therewith. Accordingly, the necessary cooling for condensing the second air stream is thus provided, and the intermediate stream is itself reboiled. The resulting boiled intermediate stream is reintroduced into the lower pressure rectification column 30 through an inlet 51 at a bottom region of the lower pressure rectification column 30.

As a result of the separation that takes place in the lower pressure rectification column 30, impure liquid oxygen product typically containing in the order of 90% by volume of oxygen is formed at the bottom of the column 30. A stream of impure liquid oxygen product is withdrawn from the bottom of the lower pressure rectification column 30 through an outlet 52 by a pump 54. The pump typically raises the pressure of the impure liquid oxygen to 8 bar or the desired delivery pressure. The resulting pressurised impure liquid oxygen flows through the main heat exchanger 6 from its cold end 10 to its warm end 8 and is thereby vaporised and warmed to approximately ambient pressure. The impure oxygen may for example be used in a combustion process. A nitrogen stream is withdrawn from the top of the lower pressure rectification column 30 through an outlet 50. The nitrogen stream flows, in sequence, through the heat exchangers 26, 34 and 10 and is thus warmed to approximately ambient temperature. The nitrogen flows through each of these heat exchangers 26, 34 and 10 from the cold end to the warm end thereof. The nitrogen may be used in another process or vented to the atmosphere.

In order to enable the vaporisation of the pressurised impure liquid oxygen product to be performed in a thermodynamically efficient manner, there is created a third air stream at a higher pressure than the first and second streams, which third air stream flows through the main heat exchanger 6 from its warm end 8 to its cold end 10. The third air stream is formed by taking a part of the air flow from intermediate the purification unit 4 and the warm end 8 of the main heat exchanger 6 and compressing it to a pressure of 20.2 bar in a compressor 56. This pressure is sufficient for the third air stream to condense in heat exchange with the boiling liquid oxygen product stream. The condensed third air stream is then reduced in pressure to approximately the operating pressure of the higher pressure rectification column 12 by passage through a pressure reducing or throttling valve 58.

Downstream of the valve 58, the third air stream is merged with the second air stream at a region intermediate the first condenser-reboiler 16 and the inlet 18 to the higher pressure rectification column 12.

Figure 2:
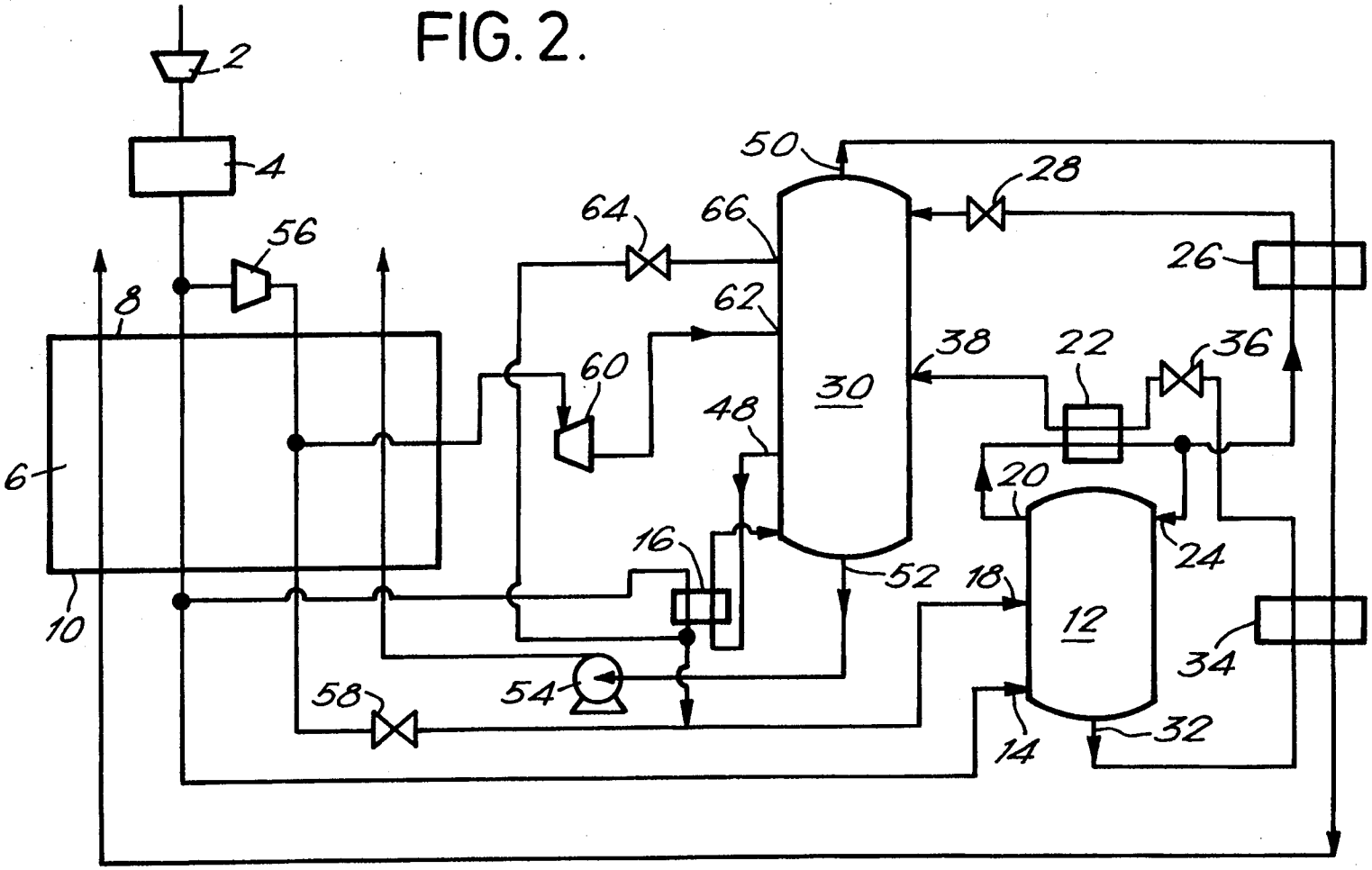

Refrigeration requirements for the plant shown in the drawing are created by withdrawing a part of the third air stream from the main heat exchanger 6 at a temperature of about 151K and expanding the withdrawn air in an expansion turbine 60 with the performance of external work. If desired, the external work may be a compression duty. The expanded air leaves the turbine 60 at a temperature of 92.4K and at approximately the pressure of the higher pressure rectification column 12, and is merged with the second air stream upstream of its passage through the first condenser-reboiler 16.

same as that shown in FIG. 1, no further description of the plant shown in FIG. 2 and its operation is given.

An illustrative example of the operation of the plant shown in FIG. 2 is however given in Tables 1 and 2 below.

TABLE 1

| Stream | State of Stream | Temperature of Stream K | Pressure of Stream bar | Flow rate of stream sm3/hr | Composition of Stream: Mole Fraction of O2 | Mole Fraction of N2 | Mole Fraction of Ar |
|---|---|---|---|---|---|---|---|
| A | Gas | 298.0 | 3.1 | 266 690 | 0.21 | 0.78 | 0.01 |
| B | Gas | 298.0 | 20.2 | 77 994 | 0.21 | 0.78 | 0.01 |
| C | Vapour | 92.4 | 3.0 | 128 696 | 0.21 | 0.78 | 0.01 |
| D | Vapour | 92.4 | 3.0 | 60 000 | 0.21 | 0.78 | 0.01 |
| E | Liquid | 89.8 | 3.0 | 60 000 | 0.21 | 0.78 | 0.01 |
| F | Liquid | 89.8 | 3.0 | 12 000 | 0.21 | 0.78 | 0.01 |
| G | Vapour | 151 | 20.1 | 24 084 | 0.21 | 0.78 | 0.01 |
| H | Gas | 294.0 | 8.0 | 61 766 | 0.90 | 0.07 | 0.03 |
| I | Liquid | 90.9 | 1.4 | 61 766 | 0.90 | 0.07 | 0.03 |
| J | Liquid | 87.6 | 2.9 | 81 510 | 0.00 | 1.00 | 0.00 |
| K | Liquid | 81.0 | 2.8 | 81 510 | 0.00 | 1.00 | 0.00 |
| L | Liquid | 87.8 | 1.3 | 52 000 | 0.74 | 0.22 | 0.03 |
| M | Liquid | 91.1 | 3.0 | 137 180 | 0.33 | 0.65 | 0.01 |
| N | Liquid | 87.0 | 3.0 | 137 180 | 0.33 | 0.65 | 0.01 |
| O | 92% vapour 8% liquid | 85.5 | 1.3 | 137 180 | 0.33 | 0.65 | 0.01 |
| P | Vapour | 79.6 | 1.3 | 204 924 | 0.00 | 0.99 | 0.00 |
| Q | Vapour | 89.4 | 1.3 | 204 924 | 0.00 | 0.99 | 0.00 |
| R | Gas | 294.0 | 1.2 | 204 924 | 0.00 | 0.99 | 0.00 |

Referring now to FIG. 2, there is shown an air separation plant essentially similar to that shown in FIG. 1. Like parts in FIGS. 1 and 2 are indicated by the same reference numerals. The differences between the construction/operation of the plant shown in FIG. 2 and the construction/operation of that shown in FIG. 1 are as follows.

First, the outlet of the turbine 60 shown in FIG. 2 communicates with an inlet 62 to the lower pressure rectification column 30 and not with the second air stream upstream of the condenser-reboiler 16 (c.f. FIG. 1). Accordingly, the expanded air leaving the turbine 60 flows directly into the lower pressure column 30.

Second, the outlet 42 from the higher pressure column 12, the pressure reducing valve 44, the inlet 46 to the lower pressure rectification column 30, and associated pipework of the plant shown in FIG. 1 are all omitted from the plant shown in FIG. 2. Thus, in the plant shown in FIG. 2, no liquid or vapour stream is taken from an intermediate region of the higher pressure rectification column 12 and introduced into an intermediate region of the lower pressure rectification column 30.

Third, in the plant shown in FIG. 2, a major part of the condensed second air stream is taken from upstream of the mixing of this stream with the third air stream downstream of the pressure reducing valve 58. The major part of the condensed air stream is passed through an expansion or pressure reducing valve 64 and introduced into the lower pressure rectification column 30 through an inlet 66 at a level above that of the inlet 62.

Fourth, in the plant shown in FIG. 2, all the fluid passing through the pressure reducing valve 36 flows through the second condenser-reboiler 22 and is typically not entirely boiled therein. Thus, in the plant shown in FIG. 2, there is no inlet to the lower pressure rectification column 30 corresponding to the inlet 40 shown in FIG. 1 of the drawings.

Since in all other respects the construction and operation of the plant shown in FIG. 2 is substantially the

TABLE 2

IDENTIFICATION OF STREAMS A TO R IN TABLE 1

Stream A—Purified air stream at outlet of purification unit 4.

Stream B—The third air stream at the outlet of the compressor 56.

Stream C—The first air stream at the inlet 14 to the higher pressure rectification column 12.

Stream D—The second air stream at its inlet to the first condenser-reboiler 16.

Stream E—The condensed second air stream at its exit from the first condenser-reboiler 16.

Stream F—That part of the condensed second air stream that is merged with the third air stream downstream of the valve 58.

Stream G—The flow of air at the inlet to the turbine 60.

Stream H—Product oxygen stream at its exit from the heat exchanger 6.

Stream I—Product oxygen stream at the outlet 52 from the lower pressure rectification column 30.

Stream J—Condensed nitrogen stream at its entrance to the heat exchanger 26.

Stream K—Sub-cooled condensed nitrogen stream at its exit from the heat exchanger 26.

Stream L—The "intermediate" liquid stream (withdrawn from the lower pressure rectification column 30) at its entrance to the condenser-reboiler 16.

Stream M—The oxygen-enriched liquid stream at the outlet 32 of the higher pressure rectification column 12.

Stream N—The sub-cooled oxygen-enriched liquid stream at its exit from the heat exchanger 34.

Stream O—The oxygen-enriched stream at its exit from the second condenser-reboiler 22.

Stream P—The nitrogen stream at the outlet 50 from the lower pressure rectification column 30.

Stream Q—The nitrogen stream at its entrance to the cold end 10 of the heat exchanger 6.

Stream R—The nitrogen stream at its exit from the warm end 8 of the heat exchanger 6.

Figure 3:
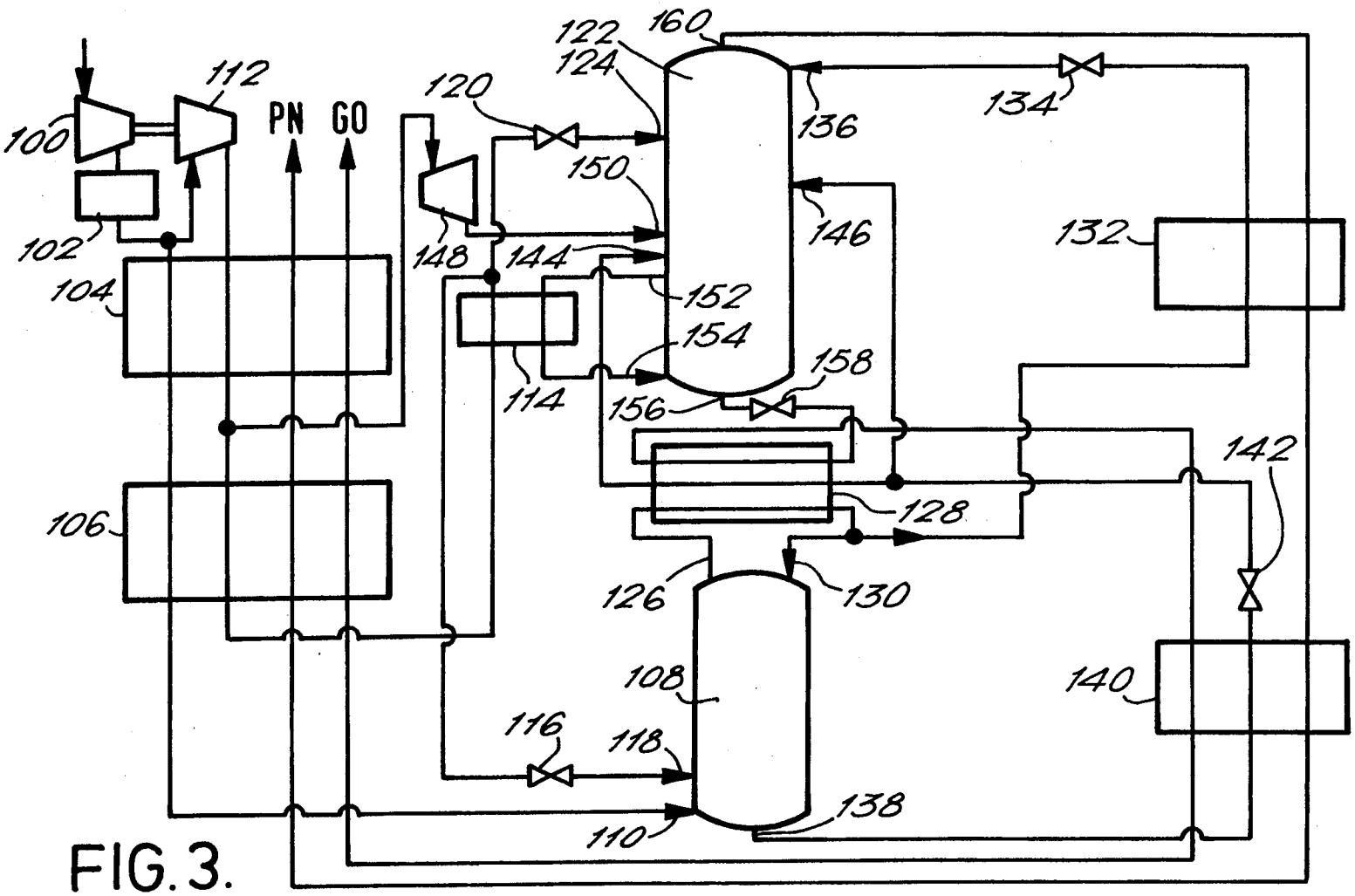

In FIG. 3 of the accompanying drawings, there is shown a plant in which the lower pressure rectification column is operated at a pressure of 4 bar to enable a pressurised nitrogen product to be produced without a nitrogen compressor being provided for this purpose. Referring to FIG. 3 air is compressed in a main compressor 100 to a pressure of 7.7 bar. The resulting flow of compressed air passes through a purification apparatus or unit 102 effective to remove water vapour and carbon dioxide from the air. The unit 102 employs beds of adsorbent (not shown) to effect the removal of water vapour and carbon dioxide. The beds are operated out of sequence with one another typically such that while one or more beds are being used to purify air the remainder are being regenerated, for example by means of a stream of hot nitrogen. Such purification apparatus and its operation are well known and need not be described further.

The purified air is divided into first and second air streams. The first air stream flows in sequence through a first main heat exchanger 104 and a second main heat exchanger 106. The first air stream is thereby reduced to a temperature suitable for its separation by rectification. The first air stream typically leaves the cold end of the second main heat exchanger as a vapour at its saturation temperature. The first air stream is introduced into a bottom region of a higher pressure rectification column 108 through an inlet 110. The higher pressure rectification column 108 contains liquid-vapour contact devices (not shown) whereby a descending liquid phase is brought into intimate contact with an ascending vapour phase such that mass transfer between the phases takes place. The liquid-vapour contact means may for example comprise distillation trays (preferably of the sieve kind) or packing (preferably structured packing). In operation of the higher pressure rectification column 108, liquid collects at the bottom thereof. Since the first air stream is introduced into a bottom region of the higher pressure rectification column 108, the liquid at the bottom of the column 108 is approximately in equilibrium with such air, and since oxygen is less volatile than the other main components (nitrogen and argon) of the air, the liquid contains a greater mole fraction of oxygen than is in the incoming gaseous air. Typically the higher pressure rectification column 108 is designed with sufficient theoretical plates to enable substantially pure nitrogen to be produced at its top. Thus, the higher pressure rectification column 108 produces an oxygen-enriched liquid fraction at its bottom and a nitrogen vapour fraction at its top.

The second stream of purified air is further compressed to a pressure of about 9.2 bar in a booster-compressor 112. Downstream of the booster-compressor 112 the second air stream is cooled to a temperature suitable for its separation by rectification, the cooling being effected by passage through the main heat exchangers 104 and 106 in sequence. The cooled second air stream flows from the cold end of the heat exchanger 106 through a first condenser-reboiler 114 in which it is wholly condensed. The condensed second air stream is divided into two subsidiary streams downstream of its passage through the first condenser-reboiler 114. One subsidiary stream passes through a throttling or pressure reducing valve 116 and is reduced in pressure to approximately the operating pressure (about 7.5 bar) of the higher pressure rectification column. This subsidiary stream flows from the pressure reducing valve 116 into the higher pressure rectification column 108 through an inlet 118. The other subsidiary condensed air stream flows through a pressure reducing valve 120 and is thereby reduced in pressure to approximately that of a lower pressure rectification column 122 (about 4.15 bar). This subsidiary condensed air stream flows from the pressure reducing valve 120 into the lower pressure rectification column 122 through an inlet 124.

Liquid nitrogen reflux for the higher pressure rectification column 108 is formed by withdrawing nitrogen vapour therefrom through an outlet 126 at its top, condensing the nitrogen vapour in a second condenser-reboiler 128 and returning a stream of the resulting condensed nitrogen to the top of the higher pressure rectification column 108 through an inlet 130. Another stream of the condensed nitrogen is sub-cooled in a heat exchanger 132 and flows through a throttling or pressure reduction valve 134. The resulting liquid nitrogen stream flows from the pressures reduction valve 134 into the lower pressure rectification column 122 through an inlet 136 at its top and serves as reflux in the column 122. The lower pressure rectification column 122 is provided with similar liquid-vapour contact devices (not shown) to those used in the higher pressure rectification column 108 in order to bring a descending liquid phase into intimate contact with an ascending vapour phase such that mass transfer between the two phases takes place.

A stream of oxygen-riched liquid is withdrawn from the bottom of the higher pressure rectification column 108 through an outlet 138, is sub-cooled in a heat exchanger 140 and flows through a pressure reducing or throttling valve 142. The resulting oxygen-rich liquid stream is divided into two subsidiary streams. A first such subsidiary stream flows through the second condenser-reboiler 128 thereby providing cooling for the condensation of the nitrogen vapour withdrawn from the higher pressure rectification column 108 through the outlet 126. The first subsidiary oxygen-rich liquid stream is boiled as a result of the heat exchanger with the condensing nitrogen vapour and the resulting oxygen-rich vapour is introduced into the lower pressure rectification column 122 through an inlet 144 at a level below that of the inlet 124. The second subsidiary oxygen-rich liquid stream is introduced into the lower pressure rectification column 122 through an inlet 146 located above the inlet 144 but below the inlet 124. A further stream of air is formed for introduction into the lower pressure rectification column 122 by taking a minor part of the second stream of purified air from intermediate the cold end of the heat exchanger 104 and the warm end of the heat exchanger 106 and causing it to flow through an expansion turbine 148. The inlet temperature of the turbine 148 is typically about 150K. The resulting expanded air leaves the turbine 148 at approximately the pressure of the lower pressure rectification column 122 and enters the column 122 through an inlet 150 at a level above that of the inlet 144 but below that of the inlet 124. The fluids introduced into the lower pressure rectification column 122 through the inlets 124, 144, 146 and 150 are separated therein into nitrogen vapour and impure liquid oxygen. The pressure at the top of the lower pressure rectification column 122 is typically in the order of 4 bar.

In order to provide an upward flow of vapour from bottom to top of the lower pressure rectification column 122, a stream (the "intermediate" stream) of liquid is withdrawn from the lower pressure rectification column 122 through an outlet 152 at a level such that the liquid contains about 80% by volume of oxygen. The intermediate stream flows through the first condenser-reboiler 114 countercurrently to the second purified air stream and thus provides cooling for the condensation of the second purified air stream. The intermediate stream is itself reboiled and the resulting vapour is introduced into a bottom region of the lower pressure rectification column through an inlet 154.

As a result of the separation that takes place in the lower pressure rectification column 122, impure liquid oxygen product typically containing in the order of 90% by volume of oxygen is formed at the bottom of the lower pressure rectification column 122. A stream of impure liquid oxygen product is withdrawn from the bottom of the lower pressure rectification column 122 through an outlet 156. The stream of impure liquid oxygen product flows through a throttling or pressure reduction valve 158 and is thereby reduced in pressure to about 1.5 bar. The impure product oxygen stream flows through the second condenser-reboiler 128 countercurrently to the condensing nitrogen stream and is thereby vaporised. The oxygen product flows from the second condenser-reboiler 128 through, in sequence, the heat exchangers 140, 106 and 104, and may be passed to, for example, a gasification or metal reforming process at ambient temperature.

A product nitrogen stream is withdrawn from the top of the lower pressure rectification column 122 the top of the lower pressure rectification column 122 through an outlet 160 at a pressure of about 4 bar and flows in sequence through the heat exchangers 132, 140, 106 and 104, passing through each from its cold end to its warm end. An elevated pressure nitrogen product at about ambient temperature is thereby produced. If desired, this product may be heated and then expanded in an expansion turbine (not shown) so as to recover work therefrom.

An illustrative example of the operation of the plant shown in FIG. 3 is given in Tables 3 and 4 below.

TABLE 3

| Stream | State of Stream | Temperature of Stream K | Pressure of Stream bar | Flow rate of stream sm3/hr | Composition of Stream: Mole Fraction of O2 | Mole Fraction of N2 | Mole Fraction of Ar |
|---|---|---|---|---|---|---|---|
| A | Gas | 293.0 | 7.7 | 100 000 | 0.21 | 0.78 | 0.01 |
| B | Vapour | 108.0 | 7.5 | 60 500 | 0.21 | 0.78 | 0.01 |
| C | Gas | 293.0 | 9.2 | 39 500 | 0.21 | 0.78 | 0.01 |
| D | Vapour | 106.6 | 9.0 | 34 500 | 0.21 | 0.78 | 0.01 |
| E | Liquid | 104.5 | 9.0 | 34 500 | 0.21 | 0.78 | 0.01 |
| F | 96% Liquid 4% Vapour | 101.8 | 7.5 | 13 000 | 0.21 | 0.78 | 0.01 |
| G | 86.5% Liquid 13.5 Vapour | 93.6 | 4.1 | 21 500 | 0.21 | 0.78 | 0.01 |
| H | Gas | 150.0 | 9.1 | 5 000 | 0.21 | 0.78 | 0.01 |
| I | Liquid | 102.3 | 4.2 | 27 006 | 0.80 | 0.16 | 0.04 |
| J | Vapour | 103.9 | 4.0 | 27 006 | 0.80 | 0.16 | 0.04 |
| K | Liquid | 104.7 | 8.0 | 41 146 | 0.37 | 0.62 | 0.01 |
| L | Liquid | 97.4 | 8.0 | 41 146 | 0.37 | 0.62 | 0.01 |
| M | 97.6% Liquid 2.4% Vapour | 95.4 | 4.1 | 41 146 | 0.37 | 0.62 | 0.01 |
| N | 97.6% Liquid 2.4% Vapour | 95.4 | 4.1 | 7 305 | 0.37 | 0.62 | 0.01 |
| O | 97.6% Liquid 2.4% Vapour | 95.4 | 4.1 | 33 841 | 0.37 | 0.62 | 0.01 |
| P | 95% Vapour 5% Liquid | 98.4 | 4.1 | 33 841 | 0.37 | 0.62 | 0.01 |
| Q | Liquid | 104.5 | 4.2 | 21 999 | 0.90 | 0.07 | 0.03 |
| R | 90% Liquid | 92.3 | 1.5 | 21 999 | 0.90 | 0.07 | 0.03 |
| S | Vapour | 93.1 | 1.5 | 21 999 | 0.90 | 0.07 | 0.03 |
| T | Gas | 290.4 | 1.3 | 21 999 | 0.90 | 0.07 | 0.03 |
| U | Liquid | 99.6 | 7.5 | 32 354 | 0.01 | 0.99 | 0.00 |
| V | Liquid | 94.0 | 7.5 | 32 354 | 0.01 | 0.99 | 0.00 |
| W | Vapour | 91.6 | 4.0 | 70 001 | 0.01 | 0.98 | 0.00 |
| X | Gas | 290.4 | 3.8 | 70 001 | 0.01 | 0.98 | 0.00 |

TABLE 4

IDENTIFICATION OF STREAMS A TO X IN TABLE 3

Stream A—Air flow out of the purification unit 102.

Stream B—First purified air stream at inlet 110 to the higher pressure rectification column 108.

Stream C—Second purified air stream at outlet from the booster compressor 112.

Stream D—Second purified air stream at its entrance to the first condenser-reboiler 114.

Stream E—Second purified air stream at its exit from the first condenser-reboiler 114.

Stream F—Air flow at inlet 118 to the higher pressure rectification column 108.

Stream G—Air flow at inlet 124 to the lower pressure rectification column 122.

Stream H—Air flow at inlet to expansion turbine 148.

Stream I—"Intermediate" stream at outlet 152 of the lower pressure rectification column 122.

Stream J—"Intermediate" stream at inlet 154 to the lower pressure rectification column 122.

Stream K—Oxygen-enriched liquid stream at the outlet 138 of the higher pressure rectification column 108.

Stream L—Oxygen-enriched liquid stream at its exit from the heat exchanger 140.

Stream M—Oxygen-enriched stream at its exit from the pressure reducing valve 142.

Stream N—Oxygen-enriched stream at the inlet 146 to the lower pressure rectification column 122.

Stream O—Oxygen-enriched stream at its entrance to the second condenser-reboiler 128.

Stream P—Oxygen-enriched stream at the inlet 144 to the lower pressure rectification column 122.

Stream Q—Impure product oxygen stream at the outlet 156 of the lower pressure rectification column 122.

Stream R—Impure product oxygen stream at its exit from the pressure reduction valve 158.

Stream S—Impure product oxygen stream at its exit from the second condenser-reboiler 128.

Stream T—Impure product oxygen stream at its exit from the warm end of the heat exchanger 104.

Stream U—Liquid nitrogen stream at its entrance to the heat exchanger 132.

Stream V—Liquid nitrogen stream at its exit from the heat exchanger 132.

Stream W—Product nitrogen stream at the outlet 160 from the lower pressure rectification column 122.

Stream X—Product nitrogen stream at its exit from the warm end of the heat exchanger 104.

In the Tables percentages of liquid and vapour are percentages by weight and sm3/hr is the unit standard cubic meters per hour.

I claim:

1. A method of separating air comprising: rectifying a first stream of air in a higher pressure rectification column and thereby producing nitrogen vapour and oxygen-enriched liquid; condensing at least some of the nitrogen vapour and employing a first stream of resulting condensate as reflux in the higher pressure rectification column and a second stream of the condensate as reflux in a lower pressure rectification column; withdrawing from the higher pressure rectification column a stream of said oxygen-enriched liquid; rectifying said stream of said oxygen enriched liquid in the lower pressure rectification column and producing thereby an impure liquid oxygen product; withdrawing said impure liquid oxygen product from the lower pressure rectification column in the liquid state; providing a flow of reboiled liquid upwardly through the lower pressure rectification column by withdrawing from the lower pressure rectification column an intermediate stream of liquid having an oxygen concentration greater than that of the said oxygen-enriched liquid but less than that of the said impure liquid oxygen product; reboiling the intermediate stream by heat exchange with a second stream of air; and returning the resulting reboiled intermediate stream to a bottom region of the lower pressure rectification column.

2. The method as claimed in claim 1, wherein the intermediate stream has an oxygen content in the range of 50% to 85% by volume.

3. The method as claimed in claim 1, in which the nitrogen vapour produced in the higher pressure rectification column is condensed by heat exchange with said oxygen-enriched liquid, at least part of said oxygen-enriched liquid thereby being vaporised upstream of its introduction into the lower pressure rectification column.

4. The method as claimed in claim 1, wherein the first and second air streams are each formed by removing carbon dioxide and water vapour from a flow of compressed air and cooling the resulting purified air flow in a main heat exchanger by countercurrent heat exchange with the impure liquid oxygen product and with a nitrogen stream withdrawn from the lower pressure rectification column.

5. The method as claimed in claim 4, in which the impure liquid oxygen is heat exchanged in the main heat exchanger with a third air stream at a pressure higher than either that of the first air stream or that of the second air stream.

6. The method as claimed in claim 5, in which the third air stream is at least partially condensed and is introduced into the higher pressure rectification column.

7. The method as claimed in claim 5, in which said third air stream is taken from said purified air flow.

8. The method as claimed in claim 5, in which a part of the third air stream is taken therefrom and is expanded with the performance of external work in an expansion turbine to the pressure of the higher pressure rectification column.

9. The method as claimed in claim 8, in which at least part of the expanded air is introduced into the higher pressure rectification column.

10. The method as claimed in claim 1, additionally including reducing the pressure of the impure oxygen product and at least partially vaporising it by countercurrent heat exchange with the condensing nitrogen vapour.

11. The method as claimed in claim 1, in which at least part of the second air stream is introduced into the higher pressure rectification column downstream of its heat exchange with the intermediate stream.

12. An apparatus for separating air comprising: a higher pressure rectification column for separating a first stream of air into nitrogen vapour and oxygen-enriched liquid; a lower pressure rectification column for producing an impure liquid oxygen product having an inlet for oxygen-enriched liquid withdrawn from said higher pressure rectification column; a condenser for condensing nitrogen separated in the higher pressure rectification column; means for supplying resulting condensate as reflux to the higher pressure rectification column and to a lower pressure rectification column; an outlet from the lower pressure rectification column for said impure liquid oxygen product; a reboiler for boiling by heat exchange with a second stream of air an intermediate stream of liquid withdrawn from the lower pressure rectification column at a region intermediate said inlet and said outlet; and means for returning the resulting reboiled liquid to the bottom of the lower pressure rectification column.

13. The apparatus as claimed in claim 12, in which the said condenser is arranged to receive in use oxygen-enriched liquid from the higher pressure rectification column.

14. The apparatus as claimed in claim 12, additionally including means for purifying a flow of compressed air by removal of water vapour and carbon dioxide therefrom, a main heat exchanger for cooling the air flow by heat exchange, in use, with the impure liquid oxygen product and a stream of nitrogen from the lower pressure rectification column, and means for taking said first and second air streams from the cooled air flow.

15. The apparatus as claimed in claim 14, additionally including a compressor for creating a third air stream from said air flow at a region intermediate said purification means and said mean heat exchanger, and means for conducting the third air stream through said main heat exchanger.

16. The apparatus as claimed in claim 15, additionally including an expansion turbine having an inlet communicating with a region of the main heat exchanger through which said third air stream is able to flow and an outlet communicating with said higher pressure rectification column.

* * * * *